United States Patent [19]

Meratti

[11] 4,127,261

[45] Nov. 28, 1978

[54] AUTOMATIC SIGNATURE OPENER

[76] Inventor: Gianattilio Meratti, Via Colle Pasta 33, Torre de' Roveri (Bergamo), Italy

[21] Appl. No.: 812,308

[22] Filed: Jul. 1, 1977

[30] Foreign Application Priority Data

Dec. 14, 1976 [IT] Italy ..... 69966 A/76

[51] Int. Cl.[2] ..... B65H 5/30

[52] U.S. Cl. ..... 270/55; 270/57

[58] Field of Search ..... 270/54–57; 271/33

[56] References Cited

U.S. PATENT DOCUMENTS 658,812 10/1900 Smyth ..... 271/33

3,661,379 5/1972 Dolfini ..... 270/57

*Primary Examiner*—Edgar S. Burr
*Assistant Examiner*—A. Heinz
*Attorney, Agent, or Firm*—Sughrue, Rothwell, Mion, Zinn and Macpeak

[57] ABSTRACT

The automatic signature opener has a continuous conveyor for the signature, a surface covered with pressure-sensitive adhesive which is brought into contact with the top sheet of the signature to lift the top sheet, a separating member for insertion between the top sheet and the remainder of the signature to hold them apart, and a member for pulling the top sheet of the signature away from the adhesive surface to release the signature from the adhesive surface.

14 Claims, 3 Drawing Figures

AUTOMATIC SIGNATURE OPENER

BACKGROUND OF THE INVENTION

The present invention relates to an automatic signature opener for opening continuously moving signatures as they are fed to a book sewer. The term "book sewer" as used herein includes any machine for attaching signatures together to form a book, the traditional way of attaching such signatures being to sew them together. The signatures themselves are primarily composed of large sheets which are folded a number of times, the final fold forming the spine of the signature. The signatures are normally stored in a stack, and in order to join them together in the book sewer, it is usually necessary to open the signature to the center in order to insert some part of the book sewer within the center of the signature, the usual procedure being to open the signature and to insert the signature over a saddle with its spine uppermost. The opening procedure is complicated by the fact that loose sheets can be inserted into various signatures of a book, and in order to open the signature to the center, a number of separate opening operations must be performed in order to raise the requisite number of sheets. Normal modern practice is to open the signature as the signature is being continuously conveyed, in order to be able to use continuously moving machinery without the changes in inertia that would occur if the signatures moved discontinuously.

The invention more specifically relates to an opener comprising conveying means for continuously conveying a succession of signatures along a conveying path and at least one operative member which engages an exposed face of a first part of the signature and draws the first part away from a second part of the signature to open the signature, a separating member for insertion between the first and second parts of the signature, to hold them apart, and releasing means for subsequently releasing the first part from the operative member. It will be understood that if one or more sheets of the signature have already been raised, said "first part" would not be the top sheet of the signature but would be the next sheet exposed for opening.

Such an opener is described in British Patent Specification No. 1,234,720, in which the operative member is a sucker which rotates about an axis spaced from and transverse to the conveying means, the releasing means being for cutting off the suction so that the first part of the signature is released from the sucker.

A specific problem arises with porous paper when sheets are being withdrawn from a stack or when signatures are being opened. There is a risk that the second sheet of the stack or the second sheet of the signature would also be picked up, and although this may not always occur, it occurs frequently enough to disturb production. If it does occur, two sheets would be fed instead of one or a signature would be opened in the wrong place. In addition, the provision of a sucker as well as the suction ducts and control gear for cutting off the suction, is relatively expensive.

It has been suggested in the past that an electrostatic effect can be used for picking up a sheet by inducing a high electrostatic charge on the operative member. However, this effect depends on the type of paper, and it is not possible to use the electrostatic effect with papers which conduct electricity to an appreciable extent.

According to the prior art, the use of a pressure-sensitive adhesive surface has been suggested for the specific purpose of removing individual paper sheets from a stack. Thus an oscillating member is used in U.S. Pat. No. 2,351,367, the member having an edge over which an adhesive tape is advanced step-wise; the successive sheets are delivered to feed rolls which remove the sheets from the pivoted member. British Patent Specification No. 961 371 discloses a like arrangement; the sheet is released from the adhesive either by holding the opposite end of the sheet so that the pivoted member pulls away from the sheet, or by using a pressure member which strips the sheet directly off the pivoted member. U.S. Pat. No. 2,919,129 discloses a somewhat similar arrangement in which the tape passes over a reciprocating roller which acts as the operative surface; in this case a short stripper arm pushes the sheet off the operative surface. British Patent Specification No. 928 559 discloses a like but more complicated arranged in which there are two rollers and in which the sheet is stripped from the rollers by withdrawing the rollers through openings in a pick-up plate. German Pat. No. 477,161 discloses the use of two parallel bars to which adhesive is applied by a roller, and French Pat. No. 1,445,891 discloses a somewhat similar arrangement using one bar.

German Pat. No. 462,025 discloses a very crude arrangement in which a guillotine for slitting envelopes open is provided with two sticky rollers for pulling the sides of the envelope apart, no arrangement being provided for stripping the envelope off the rollers apart from the resistance of the envelope itself.

None of these items of prior art relate to opening continuously moving signatures being fed to a book sewer; when moving signatures are being opened, the opening procedure is complicated by the movement of the signature itself, and the position of the signature upon the conveying means must not be substantially altered as any substantial alteration of the signature can cause false registration of the signature when entering the sewing machine or skewing of the signature to such an extent that it cannot be fed forwards to the sewing machine.

OBJECT OF THE INVENTION

The object of this invention is to provide an automatic opener for opening continuously moving signatures, which opener can be used with porous paper and works satisfactorily. It is a subsidiary object of this invention to provide a cheaper automatic opener for opening continuously moving signatures.

THE INVENTION

According to the invention, the operative member has an operative surface on which is a pressure-sensitive adhesive, and the releasing means is means for pulling the exposed face of the respective sheet or signature away from said operative surface.

ADVANTAGES OF THE INVENTION

The principal advantage of the invention is that only the first sheet of the signature is pulled by the operative member, even when the paper is porous, though the same opener can be used for non-porous paper. In addition the opener can be used with paper which has a significant electrical conductivity.

In addition, though a more expensive device can be incorporated to make the opener continuously operating without having to replace tapes, the opener can operate with very simple and inexpensive means for mounting a pressure-sensitive tape on the operative member, to provide the pressure-sensitive adhesive. The opener can be incorporated on existing machinery, either together with suckers so that the suckers can be used as an alternative, or in place of suckers.

The pressure-sensitive adhesive should be of a type sufficiently strong to draw the face but not so strong as to substantially damage the sheet or signature when said face is pulled away from said operative surface. It is found that ordinary "Scotch" tape as marketed on a transparent backing is effective. On some papers, the pressure-sensitive adhesive may carry away a little of the surface of the paper, but except in the highest quality work, this should be acceptable; some care may have to be taken to avoid removing some ink from the surface, but normally such removal is acceptable.

BRIEF DESCRIPTION OF THE DRAWINGS

The invention will be further described, by way of example, with reference to the accompanying drawings, in which.

DETAILED DESCRIPTION OF FIRST EMBODIMENT OF INVENTION

Figure 1:
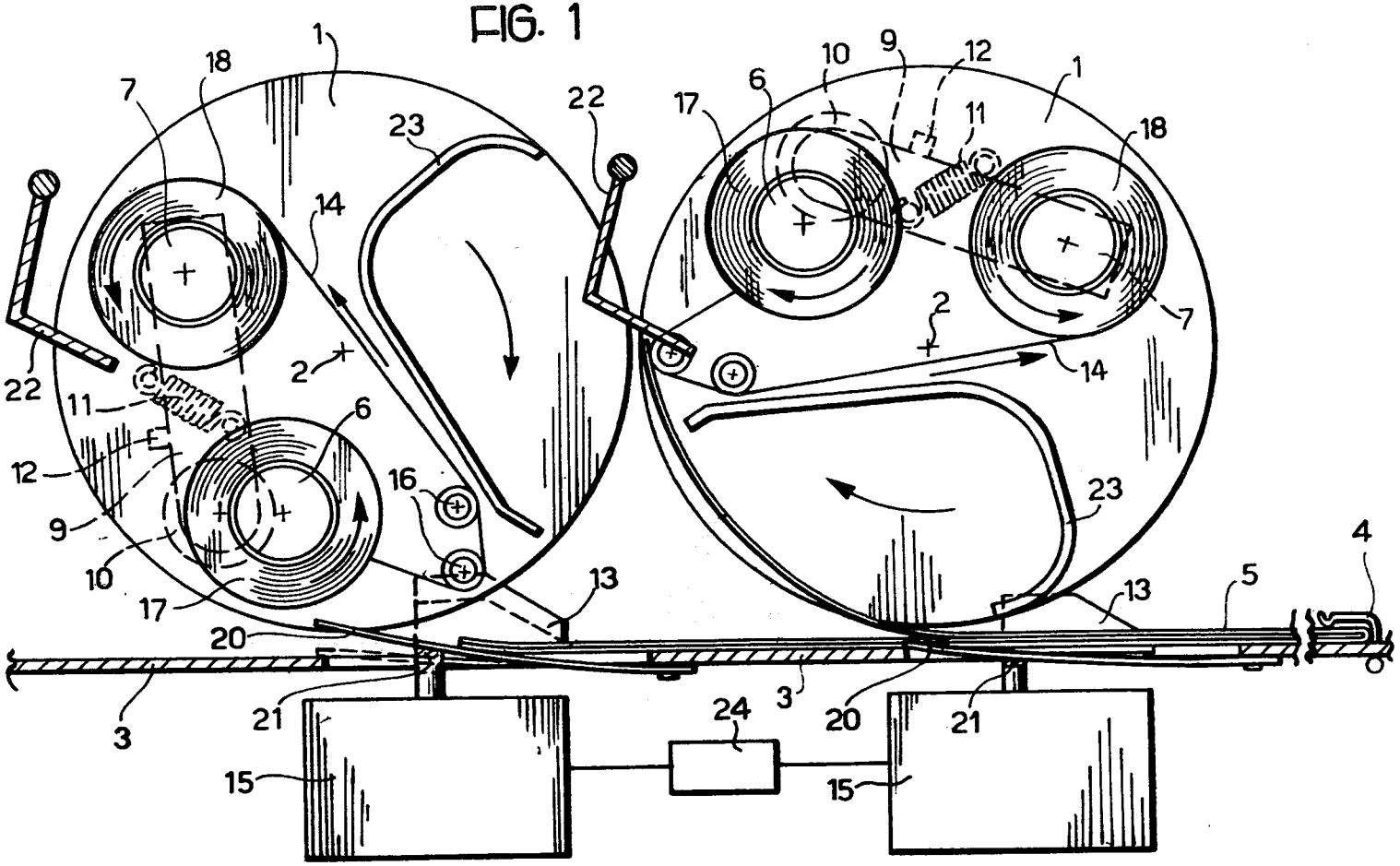
FIG. 1 is a vertical, longitudinal section through an opener in accordance with the invention, taken along the line I—I in FIG. 2, showing a left-hand operative member just before it first engages a signature and a right-hand operative member after it has picked the top sheet of the signature.

In the first embodiment, the invention is shown applied to a feeder in which successive signatures are opened. An example of such a feeder is the Head-op feeder manufactured by Meccanotecnica S.p.A. of Bergamo, Italy, and there is a description of a suitable feeder in British Patent No. 1,234,720 the disclosure of which is incorporated by reference. In the apparatus illustrated in said British Patent Specification or in my said patent application, two of the rotary suckers of the feeder are replaced by operative members 1 which rotate continuously or oscillate about fixed axes 2.

Just one of the suckers could be so replaced, but normally a succession of the suckers will be so replaced so that there is a group of the operative members 1, one closely following the other, programmed to lift a specific number of sheets of the signature so that the sheets are lifted individually until the signature is opened at the correct place.

Each operative member 1 is mounted above and to the side of a conveyor formed by a smooth, stationary support surface 3 and spine grips 4 which positively engage and close onto the spines of successive signatures 5 and propel the signatures 5 along the support surface 3, the successive signatures 5 thus being conveyed past the operative member 1. The spine grips 4 can be carried along by a driven chain below the support surface 3, the arrangement of the chain, its drive and the mechanism for closing the grips 4 and subsequently opening them not being shown as they are known from the Head-op feeder referred to above.

Each operative member 1 carries two slightly conical rotary supports 6,7. The first rotary support 6 is mounted for free rotation whilst the second rotary support 7 is connected by way of a conventional free-wheel device (not shown) to a stub shaft 8 (see FIG. 2) to which is fixed an actuating arm 9 carrying a small roller 10. A helical tension spring 11 biases the actuating arm 9 against an end stop 12. As the respective operative member 1 rotates in the direction indicated by the double arrow, the roller 10 abuts against an actuator 13 and the free-wheel device is arranged such that the actuating arm 9 thereby imparts one stepwise movement to the second rotary support 7, thus acting as means for moving a tape 14 longitudinally and stepwise in the direction indicated by the single arrow, as will be explained in more detail below. The actuator 13 is specifically designed for an operative member 1 which rotates continuously, and a different arrangement can be provided for an oscillating operative member 1. In its operative position, the actuator 13 is raised, but the actuator 13 can be lowered by a suitable mechanism 15, such as a conventional solenoid mechanism, to an inoperative position in which the roller 10 does not strike the actuator 13; the raised position is shown in full lines on the left-hand side of FIG. 1 and the lowered position is shown in full lines on the right-hand side of FIG. 1.

Figure 2:
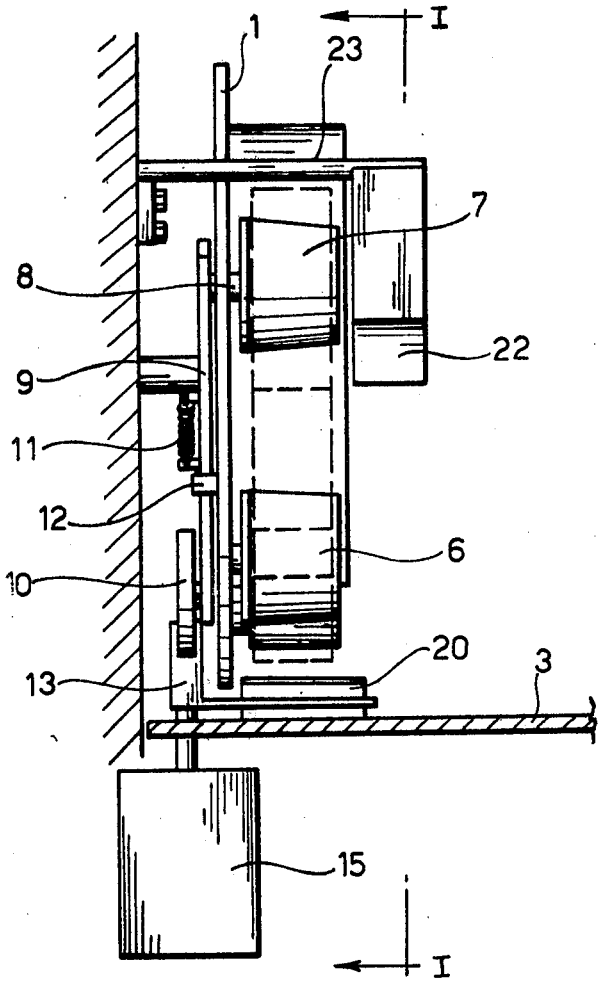
FIG. 2 is a front view of the part of the opener shown in FIGS. 1 and 2, but showing the opener inoperative without any signature in position.

The operative member 1 also carries guide elements in the form of small rollers 16, and an operator presses a fresh reel 17 of pressure-sensitive tape onto the first rotary support 6 and a take-up reel 18 on the second rotary support 7, such that, as shown in FIG. 1, the rollers 16 engage the non-adhesive surface of the tape 14 and guide the tape 14 off the fresh reel 17 and to the take-up reel 18. The part of the tape 14 which passes over one of the two rollers 16 acts as the operative surface of the operative member 1, and it will be seen that there is a pressure-sensitive adhesive on this operative surface and that as the rotary support 7 rotates step-wise to draw the tape 14 off the fresh reel 17, the pressure-sensitive adhesive of the operative surface is changed. The mechanism 15 enables the pressure-sensitive adhesive of the operative surface to remain unchanged if no signatures 5 are in position to be engaged by the operative surface.

The operative surface does not enter the normal conveying path of the signatures 5. However, on the side of the conveying path opposite the axis 2 of the operative member 1 there is a shifter member 20 in the form of a thin, flexible, springy, metal plate which moves successive signatures 5 out of the normal conveying path, to be engaged by the operative surface. The shifter member 20 is connected to the actuator 13 by a cross-piece 21 so that the shifter member 20 can be moved from a first, raised, operative position to a second, lowered, inoperative position in which the signature passes by the operative member 1 without an opening movement. If the operative member 1 is to effect an opening movement, the mechanism 15 raises the shifter member 20 shortly before the roller 10 reaches the actuator 13 and lowers the shifter member 20 after the rollers 16 have passed beyond the downstream end of the shifter member 20. If the operative member 1 is not to effect an opening movement, the shifter member 20 remains lowered.

The raised position of the shifter member 20 is such that its downstream end portion always bends slightly as the radially outer roller 16 passes over it, allowing different thicknesses of signature 5 to be opened without readjustment of the opener.

When the operative member 1 has engaged the exposed face of the respective signature 5, the rotation of the operative member 1 causes the top sheet or first part of the signature 5 to be opened, as is indicated in the right-hand side of FIG. 1, drawing the first part of the signature 5 away from the second part. Subsequently, as the signature 5 continues along its conveying path, a fixed inclined plate 22 causes the top sheet of the signature 5 to be pulled away from the operative surface, thus acting as releasing means. A suitable member can be provided for insertion between the first and second parts of the signature 5, to hold them apart and hold the top sheet of the signature 5 open, and each operative member 1 illustrated has fixed thereto a member 23 which serves this purpose for the top sheet of a signature 5 which has been opened by a preceding operative member.

As indicated schematically in FIG. 1, the mechanisms 15 are connected to a programmer 24. The programmer 24 can be an electro-mechanical programmer as already known from the Head-op feeder referred to above or as described in McCahon U.S. Pat. No. 3,591,165, and its main purpose is to determine how many operative members 1 actually act upon any signature 5 in accordance with the number of openings to be made on the signature 5.

DETAILED DESCRIPTION OF SECOND EMBODIMENT OF THE INVENTION

Figure 3:
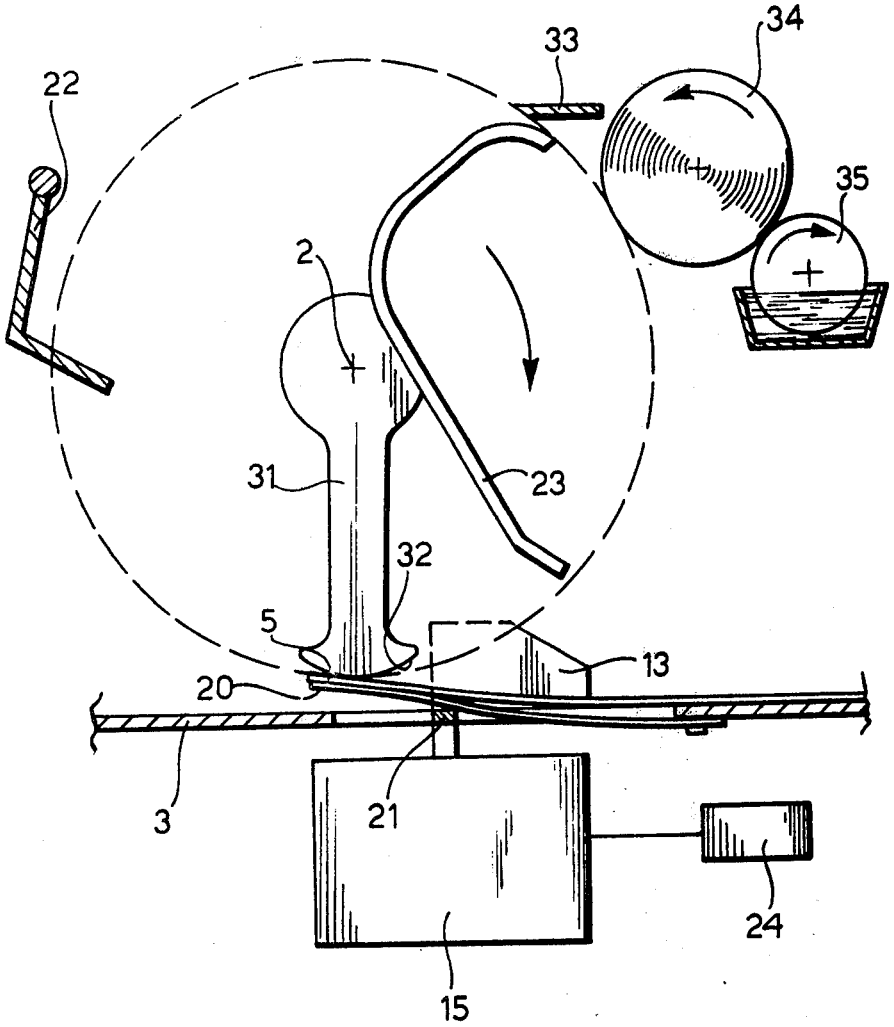
FIG. 3 is a section, corresponding to part of that of FIG. 1, but showing another opener in accordance with the invention.

The second embodiment of the invention is shown in FIG. 3, and parts which are similar to or identical with parts in the first embodiment of the invention carry the same reference numerals. The operative member 31 is a rotary arm rotating about the axis 2, having an arcuate end surface 32 which acts as the operative surface. In each revolution of the operative member 31, the operative surface 32 is scraped clean by a scraper blade 33, removing old adhesive, and then engages an applicator roll 34 which applies a suitable pressure-sensitive adhesive to the operative surface 32, the pressure-sensitive adhesive being fed to the applicator roll 34 by any suitable conventional mechanism, indicated as 35. In this case, as long as the pressure-sensitive adhesive has sufficient tackiness and does not mark the paper of the signature 5 excessively, it is not essential that it should be dry by the time the operative surface 32 reaches the signature 5. Conventional means (not shown) can be provided for withdrawing the scraper blade 33 and applicator roll 34 from the path of the operative surface 32 when no signatures 5 are to be opened.

Without departing from the principles of the invention, the details of the embodiments may be widely varied as desired. It will also be appreciated that in the first embodiment of the invention, the opener can be manufactured or sold without the tape 19 and the reels 17 and 18 in position, and the invention covers the opener in such a form.

I claim:

1. An automatic signature opener for opening continuously moving signatures as they are fed to a book sewer, the opener comprising:

conveying means for continuously conveying a succession of signatures along a conveying path;

at least one operative member adjacent the path of the signatures, the operative member providing an operative surface on which there is a pressure-sensitive adhesive;

motion-inducing means for inducing relative motion between the operative member and the respective signatures, whereby the operative surface is brought into contact with a first part of each successive signature, to thereby engage the first part, and to draw the first part away from a second part of the signature;

a separating member for insertion between the first and second parts of the signature, to hold them apart;

releasing means for subsequently releasing the first part of the signature from the operative surface; and means for replacing the pressure-sensitive adhesive of the operating surface after the release of the first part of the signature.

2. The opener of claim 1, wherein the operative surface does not enter said conveying path, and a shifter member is provided on the opposite side of said conveying path to the operative surface, for moving successive signatures out of the said conveying path to be engaged by the operative surface, to thereby provide at least in part said motion-inducing means.

3. The opener of claim 2, further characterized in that it includes means for rendering the shifter member inoperative so that the signatures pass by the operative member without an opening movement being performed on the signature.

4. The opener of claim 2, wherein the shifter member is spring-loaded.

5. The opener of claim 4, wherein the shifter member comprises a springy metal plate having a fixed end portion which the signatures reach first and a free end portion acting as the operative part of the shifter member.

6. The opener of claim 1, wherein the pressure-sensitive adhesive is carried on a tape, said changing means comprising means for moving said tape longitudinally with respect to the operative member.

7. The opener of claim 6, wherein said moving means is for moving the tape step-wise and comprises a rotary member around which the tape passes, a pivoted actuating arm connected to the rotary member by means of a free-wheel device and sprung into a rest position, and an actuator for moving the actuating arm away from its rest position and allowing the actuating arm to return, thereby moving the tape.

8. The opener of claim 1, wherein the operative member is mounted for movement whereby the operative surface moves towards and away from said conveying path, to thereby provide in part said motion-inducing means, and wherein the operative surface does not enter said conveying path but a shifter member is provided on the opposite side of said conveying path to the operative surface, the shifter member being movable between a first position in which it moves successive signatures out of conveying path to be engaged by the operative surface, to thereby provide the other part of said motion-inducing means, and a second position in which the shifter member is inoperative so that the signatures pass by the operative member without an opening movement being performed on the signatures, and wherein said changing means comprises a first actuating member moving with the shifter member and a second actuating member mounted on the operative member whereby as the operative member moves, the second actuating member engages the first actuating member to replace the pressure-sensitive adhesive if the shifter member is in its first position and does not so engage the first actuating member if the shifter member is in its second position.

9. The opener of claim 1, wherein said changing means comprises means for removing pressure-sensitive adhesive from the operative surface and means for supplying fresh pressure-sensitive adhesive to the operative surface.

10. The opener of claim 1, and further comprising means for preventing actuation of said changing means, whereby when no signature is in a position to be engaged by said operative surface, the pressure-sensitive adhesive of the operative surface is not replaced.

11. The opener of claim 1, wherein the operative member is mounted for movement whereby the operative surface moves towards and away from said conveying path, and a stationary member is mounted to be engaged by the first part of the signature as the operative surface moves away from the conveying path, to strip the first part of the signature from the operative surface and thereby provide said releasing means.

12. The opener of claim 1, wherein the operative member is mounted for movement whereby the operative surface moves towards and away from said conveying path, to thereby provide at least in part said motion-inducing means.

13. The opener of claim 1, wherein the operative member is mounted for movement whereby the operative surface moves towards and away from said conveying path, to thereby provide in part said motion-inducing means, and wherein the operative surface does not enter said conveying path but a shifter member is provided on the opposite side of said conveying path to the operative surface for moving successive signatures out of said conveying path to be engaged by the operative surface, to thereby provide another part of said motion-inducing means.

14. An automatic signature opener for opening continuously moving signatures as they are fed to a book sewer, the opener comprising:

conveying means for continuously conveying a succession of signatures along a conveying path;

engaging means included in said conveying means for engaging each successive signature and holding the signature securely on the conveying means;

at least one operative member mounted adjacent said conveying path for rotary movement about an axis spaced from and transverse to said conveying path and lying in a plane parallel to the plane of the signatures;

means mounting a pressure-sensitive adhesive tape on the operative member so that the tape provides an operative surface on which there is a pressure-sensitive adhesive, which operative surface approaches close to said conveying path;

a shifter member on the opposite side of said conveying path to the operative surface for moving successive signatures out of said conveying path to be engaged by the operative surface, whereby the operative surface is brought into contact with a first part of each successive signature, to thereby draw the first part away from a second part of the signature;

means for rendering the shifter member inoperative so that the signatures can pass by the operative member without an opening movement being performed on the signatures;

a separating member for insertion between the first and second parts of the signatures, to hold them apart;

a stationary release member which is engaged by the first part of the signature which is engaged by the operative surface, for stripping the first part of the signature away from the operative surface as the operative member rotates; and moving means for moving the tape on by one step after the release of the first part of the signature.

* * * * *